US007502004B2

(12) United States Patent
Park

(10) Patent No.: US 7,502,004 B2
(45) Date of Patent: Mar. 10, 2009

(54) DRIVING METHOD OF FS-LCD

(75) Inventor: Jun-Ho Park, Busan (KR)

(73) Assignee: Samsung Mobile Display Co., Ltd., Suwon-si (KR)

( * ) Notice: Subject to any disclaimer, the term of this patent is extended or adjusted under 35 U.S.C. 154(b) by 659 days.

(21) Appl. No.: 11/062,073

(22) Filed: Feb. 16, 2005

(65) Prior Publication Data

US 2005/0184945 A1 Aug. 25, 2005

(30) Foreign Application Priority Data

Feb. 19, 2004 (KR) ..... 10-2004-0011144

(51) Int. Cl.
*G09G 3/36* (2006.01)

(52) U.S. Cl. ..... 345/89; 345/87

(58) Field of Classification Search ..... 345/87–100, 345/204

See application file for complete search history.

(56) References Cited

U.S. PATENT DOCUMENTS

| | | | | |
|---|---|---|---|---|
| 5,614,922 | A * | 3/1997 | Kawaguchi et al. | 345/89 |
| 5,784,042 | A * | 7/1998 | Ono et al. | 345/94 |
| 6,567,063 | B1 | 5/2003 | Okita | |
| 7,002,540 | B2 * | 2/2006 | Aoki | 345/89 |
| 7,123,226 | B2 * | 10/2006 | Ham | 345/89 |
| 7,173,591 | B2 * | 2/2007 | Monomohshi | 345/96 |
| 7,199,780 | B2 | 4/2007 | Sekine | |
| 7,348,953 | B1 * | 3/2008 | Satake | 345/97 |
| 2002/0047568 | A1 * | 4/2002 | Koyama | 315/169.3 |
| 2003/0006954 | A1 * | 1/2003 | Iba | 345/90 |
| 2004/0113879 | A1 * | 6/2004 | Sekiguchi et al. | 345/94 |
| 2006/0267899 | A1 * | 11/2006 | Yamazaki | 345/97 |
| 2007/0182700 | A1 * | 8/2007 | Baba et al. | 345/102 |

FOREIGN PATENT DOCUMENTS

| | | |
|---|---|---|
| CN | 1474220 A | 2/2004 |
| JP | 8-263024 | 10/1996 |

(Continued)

OTHER PUBLICATIONS

Patent Abstracts of Japan for Publication No. 2003-098505, publication date Apr. 3, 2003, in the name of Yutaka Ozaki.

(Continued)

*Primary Examiner*—Nitin Patel
(74) *Attorney, Agent, or Firm*—Christie, Parker & Hale, LLp

(57) ABSTRACT

A method of driving a liquid crystal display (LCD) in an analog driving manner capable of improving a response speed. In an LCD having a liquid crystal disposed between upper and lower substrates, a method of sequentially driving the liquid crystal to display a desired color per each of subframes constituting one frame is provided. The method includes applying at least one of first analog voltage signals for displaying gray scales corresponding to gray scale data to the liquid crystal in a first screen period of each of the subframes and driving the liquid crystal to display at least one of the gray scales; and applying a second analog voltage signal having substantially the same absolute value as a biggest value among absolute values of the first analog voltage signals to the liquid crystal to reset the liquid crystal in a second screen period of each of the subframes.

22 Claims, 5 Drawing Sheets

FOREIGN PATENT DOCUMENTS

| | | |
|---|---|---|
| JP | 2001-042286 | 2/2001 |
| JP | 2001-100183 | 4/2001 |
| JP | 2001-272651 | 10/2001 |
| JP | 2001-318363 | 11/2001 |
| JP | 2002-236472 | 8/2002 |
| JP | 2002-263472 | 8/2002 |
| JP | 2003-507763 | 2/2003 |
| JP | 2003-098505 | 4/2003 |
| JP | 2003-099015 | 4/2003 |
| JP | 2003-107425 | 4/2003 |
| JP | 2003-114661 | 4/2003 |
| JP | 2003-241165 | 8/2003 |
| KR | 2002-0059220 | 7/2002 |
| WO | WO 01/13352 A1 | 2/2001 |

OTHER PUBLICATIONS

Patent Abstracts of Japan for Publication No. 2003-099015, publication date Apr. 4, 2003, in the name of Yutaka Ozaki.

Patent Abstracts of Japan for Publication No. 2003-107425, publication date Apr. 9, 2003, in the name of Yutaka Ozaki.

Chinese Office Action dated Jun. 8, 2007, including English translation, for corresponding Chinese Patent Application No. 200510074143.8.

Korean Patent Abstracts, Publication No. 1020020059220 A, dated Jul. 12, 2002, in the name of Shinichi Shimomaki.

Patent Abstracts of Japan, Publication No. 08-263024, dated Oct. 11, 1996, in the name of Ruquiya Ismat Ara Huq et al.

Patent Abstracts of Japan, Publication No. 2002-236472, dated Aug. 23, 2002, in the name of Masaaki Hiroki.

Patent Abstracts of Japan, Publication No. 2003-114661, dated Apr. 18, 2003, in the name of Hideto Iizaka.

* cited by examiner

DRIVING METHOD OF FS-LCD

CROSS-REFERENCE TO RELATED APPLICATION

This application claims priority to and the benefit of Korean Patent Application No. 10-2004-0011144, filed Feb. 19, 2004, the contents of which are incorporated herein by reference in their entirety.

BACKGROUND OF THE INVENTION

1. Field of the Invention

The present invention relates to a field sequential driving type liquid crystal display (FS-LCD) and, more particularly, to a method of driving an analog driving type LCD capable of improving a response speed.

2. Description of Related Art

A color LCD generally includes a liquid crystal panel including an upper substrate, a lower substrate, and a liquid crystal injected between the upper and lower substrates, a driving circuit for driving the liquid crystal panel, and a backlight for providing white light or other color lights to the liquid crystal. Such a color LCD may be mainly classified into a color filter type or a color field sequential driving type based on the manner in which it is driven.

The FS-LCD allows red (R), green (G), and blue (B) backlights to be arranged in one pixel that is not divided into R, G, and B subpixels, wherein light of the three primary colors is provided from the R, G, and B backlights to one pixel through the liquid crystal so that they are sequentially displayed in a time division manner, thereby displaying a color image using a residual effect.

The color FS-LCD sets a plurality of reference voltages corresponding to the number of gray scales to be displayed, and one reference voltage corresponding to the gray scale data among the plurality of reference voltages is selected using an analog switch, and the selected reference voltage drives the liquid crystal panel, and the gray scale is displayed by the amount of transmitted light corresponding to the applied voltage.

FIG. 1 is a diagram for explaining a conventional analog method of driving an LCD, which shows waveforms for explaining a method of driving the LCD to display the gray scales by varying the driving voltage of the liquid crystal. FIG. 1 shows the driving voltages applied to the liquid crystal and the corresponding waveforms with respect to the amount of light transmitted through the liquid crystal.

Referring to FIG. 1, a driving voltage of V11 level is applied to the liquid crystal during a period (T1) from t1 to t3 in time, and light corresponding to the driving voltage of V11 level is transmitted through the liquid crystal. A driving voltage of V12 level, which is higher than V11 level, is applied during a period (T2) from t4 to t6, and the amount of transmitted light corresponding to the driving voltage of V12 level is obtained. A driving voltage of V13 level which is higher than V11 and V12 levels is applied during a period (T3) from t7 to t9, and the amount of transmitted light corresponding to the driving voltage of V13 level is obtained.

In effect, R color is displayed during a period Tr from t2 to t3 in which an R light emitting diode of the R backlight emits light, G color is displayed during a period Tg from t5 to t6 in which a G light emitting diode of the G backlight emits light, and B color is displayed during a period Tb from t8 to t9 in which a B light emitting diode of the B backlight emits light.

Such an analog driving method of varying the driving voltage has a problem in that the response speed of the liquid crystal is slow due to a delayed falling time of the liquid crystal. In addition, it is difficult to implement time-varying images due to the decreased response speed of the liquid crystal.

Methods for coping with the above-mentioned problem by displaying the gray scale by means of digital control are disclosed in JP Patent Publication Nos. 2003-98505, 2003-099015, and 2003-107425.

One of the digital gray scale display methods includes storing voltage-applied times corresponding to the gray scales in a look-up table, reading out the voltage-applied time corresponding to the gray scale data from the look-up table, and applying a constant voltage to the liquid crystal during the voltage-applied time read from the look-up table to display the gray scale. The method includes making constant the driving voltage applied to the liquid crystal and controlling the voltage-applied time to display the gray scale. Accordingly, the response speed of the liquid crystal in response to the gray scale level may be improved by making the driving voltage constant and controlling voltage applied state and non-voltage applied state in a timing manner.

Another method for displaying the gray scale by means of digital control includes storing applied patterns corresponding to the gray scales in a look-up table, reading out the applied patterns corresponding to the gray scale data from the look-up table, and applying driving voltages of constant levels to the liquid crystal in response to the applied patterns read out from the look-up table during a unit period of emitting light of the light emitting diode to display the gray scale. This method includes varying the applied patterns during the unit period of emitting light of the light emitting diode to control voltage applied state and non-voltage applied state in a timing manner. Accordingly, the response speed of the liquid crystal may be improved by displaying the gray scale in response to the voltage-applied time.

Yet another method for displaying the gray scale by means of digital control includes corresponding each area which has integrated waveforms of light transmitting the liquid crystal with light emitting periods of the light emitting diode (LED) to each gray scale when the driving voltage is applied to the liquid crystal, and varying the areas to display the gray scales.

According to the above-mentioned method of integrating the transmitted light, the voltage-applied time is set in consideration of areas which have integrated waveforms of light transmitted through the liquid crystal with light emitting periods of the LED, so that a fine gray scale suitable for displaying the gray scale may be implemented, and the waveforms of transmitted light are rapidly falling and rising, thereby improving the response speed of the liquid crystal.

FIG. 2 shows waveforms for explaining a method of driving the conventional digital driving type LCD, which shows waveforms in response to driving data of predetermined bits and resultant waveforms of the amount of light transmitted through the liquid crystal.

Referring to FIG. 2, driving data corresponding to each gray scale are provided as digital signals of predetermined bits, for example, 7 bits, and the driving voltage corresponding to the driving data of 7 bits is applied to the liquid crystal. The applied driving voltage determines the amount of light transmitted through the liquid crystal to display the gray scale.

However, the number of bits of the driving data in the above-mentioned conventional digital driving type should increase in order to display the full color gray scale at a fast response speed. In the meantime, the FS-LCD sequentially drives R, G, and B LEDs in a time-sharing manner as compared to a general LCD, so that it has a driving frequency higher than that of the general LCD. Accordingly, when the number of bits of the driving data increases in order to display the full color gray scale at a fast response speed, the driving frequency should also be increased.

As this driving frequency increases, a problem arises that image quality is deteriorated due to distortion resulting from a gate driving voltage and a common power source Vcom. In addition, the liquid crystal is fast driven by a high driving frequency, which causes the power consumption to be increased. Further, in accordance with the conventional digital driving type, the gray scale to be currently displayed has an effective value response different from that of the gray scale that has been displayed just before, which causes the gray scale not to be exactly displayed. In particular, when an intermediate gray scale is required to be displayed, the influence of the gray scale that has been displayed just before on the gray scale to be currently displayed is further increased.

As such, a method for displaying the gray scale using a reset pulse for coping with the problem of the conventional driving type that the effective value response is changed due to the gray scale that has been displayed just before, is disclosed in U.S. Pat. No. 6,567,063.

FIG. 3 shows waveforms for explaining a conventional method for displaying digital gray scales using reset pulses. Referring to FIG. 3, a plurality of periods T31-T36 are periods in which R, G, and B LEDs for R, G, B backlights are driven to display the gray scales with respect to R, G, and B colors per each of the periods.

A predetermined voltage VLC corresponding to R gray scale data is applied to the liquid crystal in the period T31, and light is transmitted through the liquid crystal in response to the applied voltage, so that R light is displayed in a period where the R LED (RLED) emits light. A predetermined voltage VLC corresponding to G gray scale data is applied to the liquid crystal in the period T32, and light is transmitted through the liquid crystal in response to the applied voltage, so that G light is displayed in a period where the G LED (GLED) emits light. In the meantime, a predetermined voltage VLC corresponding to B gray scale data is applied to the liquid crystal in the period T33, and light is transmitted through the liquid crystal in response to the applied voltage, so that B light is displayed in a period where the B LED (BLED) emits light. Accordingly, a color having desired gray scales is displayed.

In accordance with the above-mentioned digital driving type, a predetermined voltage is applied, which has a different absolute value from that of the gray scale data and is irrelevant to the gray scale data during each predetermined time t31-t36 at each ending point of the periods T31-T36. Accordingly, R, G, and B colors having predetermined gray scales are displayed during each of the periods T31-T36 and the voltage that is irrelevant to the gray scale data is provided at each ending point of the periods so that no light may be transmitted. Accordingly, when the liquid crystal is driven by the applied voltage corresponding to the gray scale data during each of the periods T31-T36, liquid crystal state as well as transmissivity in the previous period does not affect the current period, which leads to an improvement in the response speed of the liquid crystal. In this case, the applied signal at an ending point of each period T31-T36 is referred to as a reset pulse, which improves the response speed of the liquid crystal.

Accordingly, the above-mentioned digital gray scale display method advantageously improves the response speed of the liquid crystal to implement dynamic images. However, in the digital gray scale display method, predetermined bits of driving data should be allocated to the number of reset pulses, so that the number of driving data bits is further increased as compared to the typical digital driving type. As the number of driving data bits increases, the driving frequency increases, which leads to an increase in power consumption as mentioned above, so that the problem of deteriorating the image quality due to distortion of the gate voltage and common voltage is still present.

As a result, when the LCD is driven in the above-mentioned digital manner, the gate pulse width having a threshold value or more should be maintained, which causes the driving speed to be limited, and also limits an increase of a frame frequency for preventing flicker from occurring. Accordingly, an inversion-driving type for improving the image quality cannot be applied, which results in problems such as crosstalk, flicker, and so forth.

SUMMARY OF THE INVENTION

In exemplary embodiments according to the present invention, therefore, is provided a solution to aforementioned problems using a method of driving an LCD capable of improving a response speed without increasing the number of driving data bits to display full color gray scales.

In exemplary embodiments according to the present invention, is provided a solution to aforementioned problems using a method of driving an LCD capable of preventing voltage distortion resulted from the decrease of a driving frequency and reducing the power consumption.

In an exemplary embodiment according to the present invention, a method of driving a liquid crystal display (LCD) having a liquid crystal disposed between upper and lower substrates includes: applying a first analog voltage signal to the liquid crystal to reset the liquid crystal; and applying at least one of a plurality of second analog voltage signals corresponding to gray scale data for displaying gray scales to the liquid crystal and driving the liquid crystal to display at least one of the gray scales. The first analog voltage signal has substantially the same absolute value as a biggest value among absolute values of the second analog voltage signals.

The first analog voltage signal may be a reset signal that is irrelevant to the second analog voltage signals for displaying the gray scales, and the second analog voltage signals may be data signals having voltage levels different from one another in response to the gray scale data, and may be irrelevant to a voltage level of the first analog voltage signal.

In another exemplary embodiment according to the present invention, a method of driving a liquid crystal display (LCD) having a liquid crystal disposed between upper and lower substrates includes: applying at least one of first analog voltage signals corresponding to gray scale data for displaying gray scales to the liquid crystal and driving the liquid crystal to display at least one of the gray scales; and applying a second analog voltage signal having substantially the same absolute value as a biggest value among absolute values of the first analog voltage signals to the liquid crystal to reset the liquid crystal.

The second analog voltage signal may be a reset signal irrelevant to the first analog voltage signals for displaying the gray scales, and the first analog voltage signals may be data signals having voltage levels different from one another in response to the gray scale data, and may be irrelevant to a voltage level of the second analog voltage signal.

In yet another exemplary embodiment according to the present invention, in a liquid crystal display (LCD) having a liquid crystal disposed between upper and lower substrates, a method of sequentially driving the liquid crystal to display a desired color during a period that is divided into a plurality of sections includes: applying at least one of first analog voltage signals corresponding to a gray scale data for displaying gray scales to the liquid crystal per each of the sections and driving the liquid crystal to display at least one of the gray scales; and applying a second analog voltage signal having substantially the same absolute value as a biggest value among absolute values of the first analog voltage signals to the liquid crystal to reset the liquid crystal. The liquid crystal is sequentially driven to display one color per each of the sections so that the desired color is displayed during the period.

The period may be one frame, and the one frame may include at least two subframes selected from Red (R), Green (G), Blue (B), and White (W) subframes. The second analog voltage signal may be a reset signal irrelevant to the first analog voltage signals for displaying the gray scales, and the first analog voltage signals may be data signals having voltage levels different from one another in response to the gray scale data, and may be irrelevant to a voltage level of the second analog voltage signal.

In yet another exemplary embodiment according to the present invention, in a liquid crystal display (LCD) having a liquid crystal disposed between upper and lower substrates, a method of sequentially driving the liquid crystal to display a desired color during a period that is divided into a plurality of sections includes: applying a first analog voltage signal to the liquid crystal to reset the liquid crystal per each of the sections; and applying at least one of second analog voltage signals corresponding to gray scale data for displaying gray scales to the liquid crystal and driving the liquid crystal to display at least one of the gray scales. The first analog voltage signal is a signal having substantially the same absolute value as a biggest value among absolute values of the second analog voltage signals, and the liquid crystal is sequentially driven to display one color per each of the sections so that the desired color is displayed during the period.

The period may be one frame, and the one frame may include at least two subframes selected from Red (R), Green (G), Blue (B), and White (W) subframes. The first analog voltage signal may be a reset signal irrelevant to the second analog voltage signals for displaying the gray scales, and the second analog voltage signals may be data signals having voltage levels different from one another in response to the gray scale data, and may be irrelevant to a voltage level of the first analog voltage signal.

In yet another exemplary embodiment according to the present invention, in a liquid crystal display (LCD) having a liquid crystal disposed between upper and lower substrates, a method of sequentially driving the liquid crystal to display a desired color per each of subframes constituting one frame includes: applying at least one of first analog voltage signals for displaying gray scales corresponding to gray scale data to the liquid crystal in a first screen period of each of the subframes and driving the liquid crystal to display at least one of the gray scales; and applying a second analog voltage signal having substantially the same absolute value as a biggest value among absolute values of the first analog voltage signals to the liquid crystal to reset the liquid crystal in a second screen period of each of the subframes. Each of the subframes includes the first screen period for displaying at least one of the gray scales and the second screen period for resetting the liquid crystal, and the liquid crystal is sequentially driven to display one color per each of the subframes so that the desired color is displayed.

The one frame may include at least two subframes selected from Red (R), Green (G), Blue (B), and White (W) subframes. The second analog voltage signal applied in the second screen period may be a reset signal that is irrelevant to the first analog voltage signals for displaying the gray scales applied in the first screen periods, and the first analog voltage signals applied in the first screen periods may be data signals having voltage levels different from one another in response to the gray scale data, and may be irrelevant to a voltage level of the second analog voltage signal provided in the second screen period.

In yet another exemplary embodiment according to the present invention, in a liquid crystal display (LCD) having a liquid crystal disposed between upper and lower substrates, a method of sequentially driving the liquid crystal to display a desired color per each of subframes constituting one frame includes: applying a first analog voltage signal to the liquid crystal to reset the liquid crystal in a first screen period of each of the subframes; and applying at least one of second analog voltage signals corresponding to gray scale data for displaying gray scales to the liquid crystal and driving the liquid crystal to display at least one of the gray scales in a second screen period of each of the subframes. Each of the subframes includes the first screen period for resetting the liquid crystal and the second screen period for displaying at least one of the gray scales, and the first analog voltage signal is a signal having substantially the same absolute value as a biggest value among absolute values of the second analog voltage signals, and the liquid crystal is sequentially driven to display one color per each of the subframes so that the desired color is displayed.

The one frame may include at least two subframes selected from Red (R), Green (G), Blue (B), and White (W) subframes. The first analog voltage signal applied in the first screen period may be a reset signal that is irrelevant to the second analog voltage signals for displaying the gray scales applied in the second screen periods, and the second analog voltage signals applied in the second screen periods may be data signals having voltage levels different from one another in response to the gray scale data, and may be irrelevant to a voltage level of the first analog voltage signal applied in the first screen period.

BRIEF DESCRIPTION OF THE DRAWINGS

The above and other features of the present invention will be described in reference to certain exemplary embodiments thereof with reference to the attached drawings in which.

DETAILED DESCRIPTION

Figure 1:
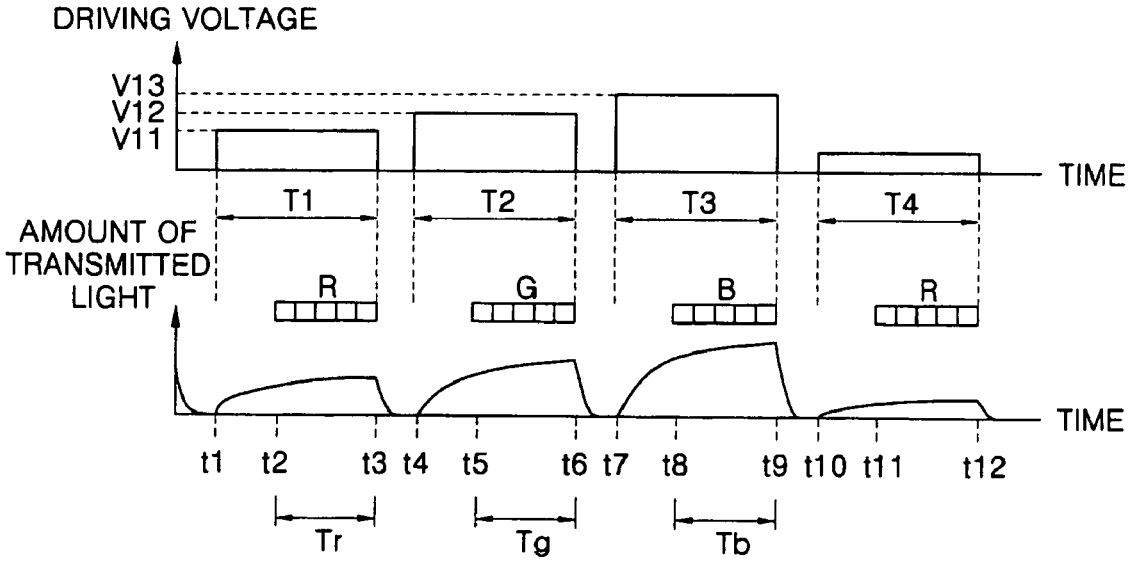
FIG. 1 (PRIOR ART)
FIG. 1 shows waveforms for explaining a conventional analog method of driving an LCD.
Figure 2:
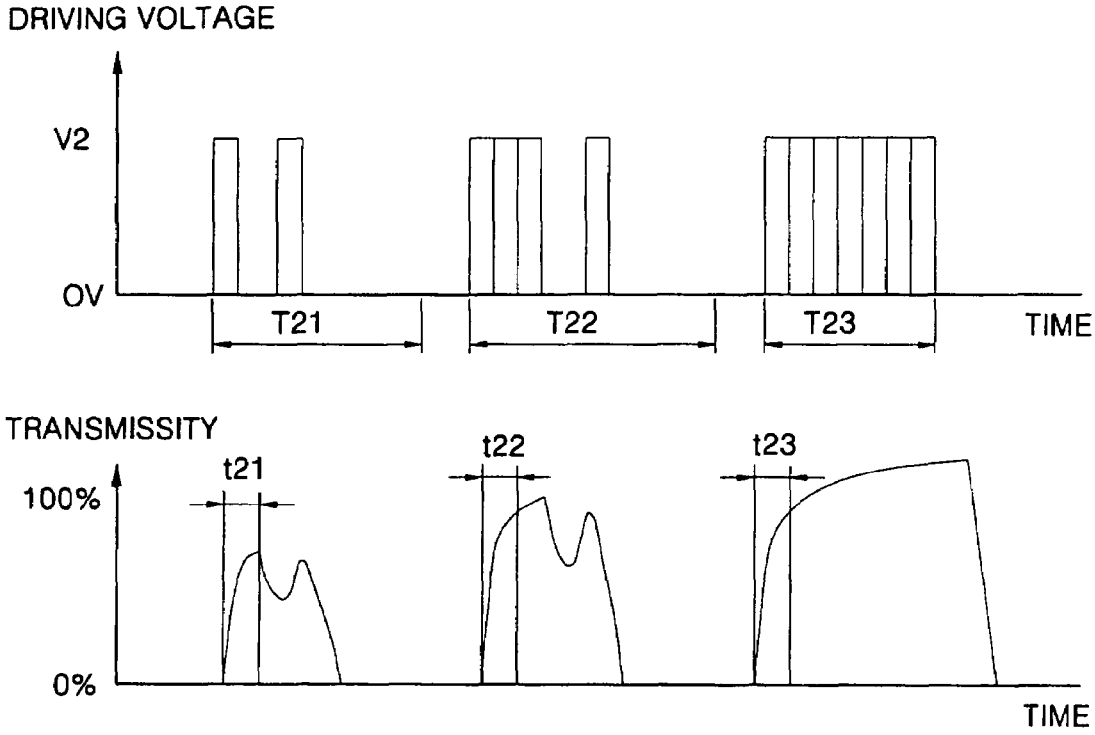
FIG. 2 (PRIOR ART)
FIG. 2 shows waveforms for explaining a conventional digital method of driving an LCD.
Figure 3:
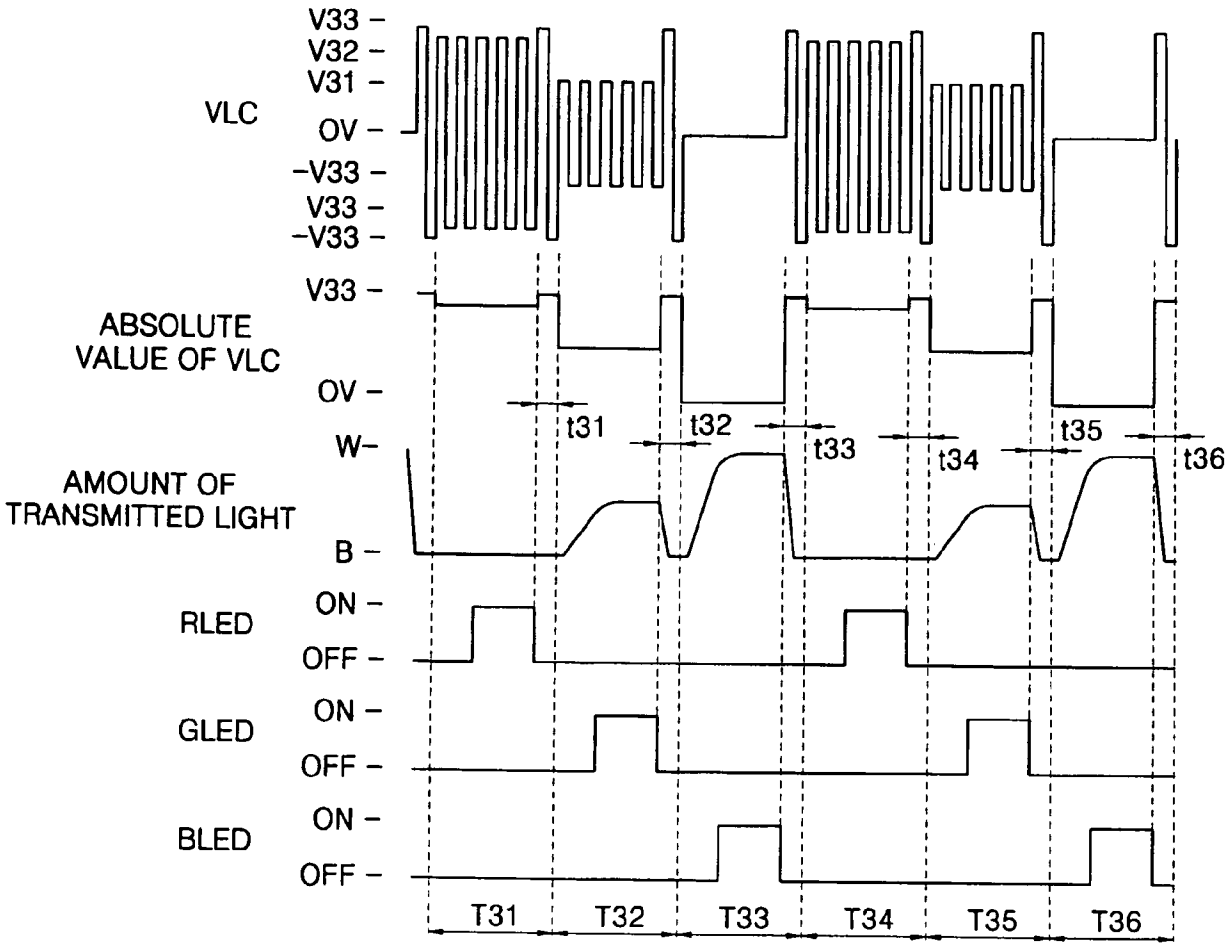
FIG. 3 (PRIOR ART)
FIG. 3 shows waveforms for explaining a conventional digital method of driving an LCD using reset pulses.
Figure 4:
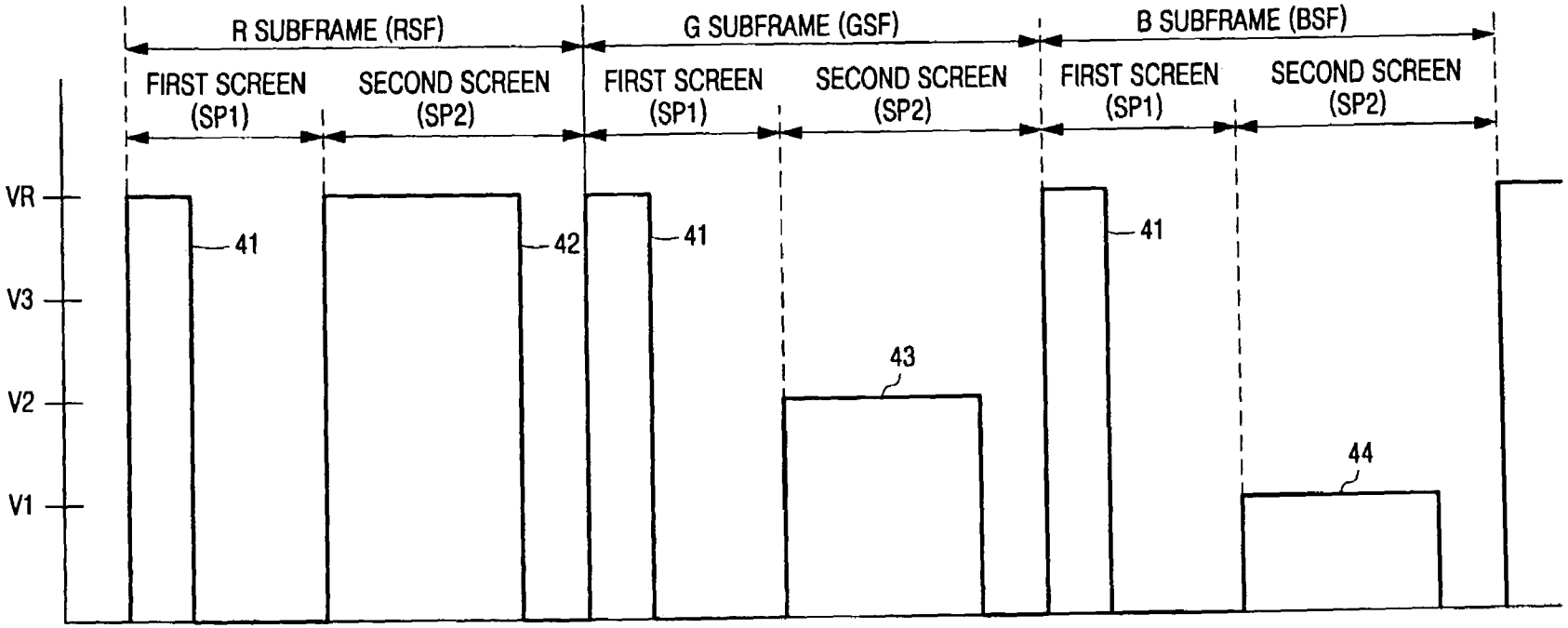
FIG. 4 shows waveforms for explaining a method of driving an LCD using reset pulses in accordance with an exemplary embodiment of the present invention.

The present invention will now be described more fully hereinafter with reference to the accompanying drawings, in which exemplary embodiments of the invention are shown. Referring to FIG. 4, in an exemplary embodiment of the present invention, one frame is divided into R, G and B subframes RSF, GSF and BSF, and each of R, G and B subframes RSF, GSF and BSF is divided into two periods.

In other words, each of the R, G, and B subframes RSF, GSF and BSF is divided into a first screen period SP1 and a second screen period SP2, and analog voltage signals 41 for reset are applied to return the liquid crystal to a black state so that no light is transmitted in the first screen period SP1. In addition, analog voltage signals 42, 43 and 44 having different voltage levels from one another corresponding to gray scale data required to be displayed are applied in the second screen periods SP2 of the RSF, GSF and BSF, respectively, in a manner similar to that of the conventional analog mode.

In other words, the reset pulse 41 has a voltage level VR irrelevant to that of the gray scale data, and has substantially the same voltage level as that (VR) having the biggest value among absolute values of voltage levels V1, V2 and VR of the data voltages 42, 43 and 44. Referring to FIG. 4, the data voltages 42, 43 and 44 for displaying the gray scale are shown to have voltage levels VR, V2 and V1 during the second screen periods SP2 of the R, G, and B subframes, respectively. The voltage levels of the data voltages 42, 43 and 44 for displaying the gray scales are determined by the level of gray scales required to be displayed, and the reset signal has substantially the same voltage level as the voltage level having the largest absolute value among voltage levels of the data voltages 42, 43 and 44 for displaying the gray scales provided in the second screen periods SP2 of the R, G and B subframes.

A method of driving the liquid crystal by dividing each of the R, G and B subframes RSF, GSF and BSF into the first screen period SP1 and the second screen period SP2 will be described with reference to FIG. 4.

R, G, and B LEDs for R, G, and B backlights are driven in the R, G and B subframes RSF, GSF and BSF to display the gray scales with respect to R, G and B colors, thereby displaying a desired color during one frame.

In other words, an analog voltage signal 41 having a predetermined level VR irrelevant to the R gray scale data is applied to the liquid crystal in the first screen period SP1 of the R subframe RSF. Accordingly, the liquid crystal returns to its original state to be black in response to the analog voltage signal 41. An analog voltage signal 42 having a voltage level VR corresponding to the R gray scale data is then applied to the liquid crystal in the second screen period SP2, which in turn allows light to be transmitted in response to the applied voltage, so that R light is displayed in a period where the RLED emits light. The liquid crystal, which has been driven by the B gray scale data in the previous B subframe BSF, is reset by the analog voltage signal 41 for reset when the R gray scale is displayed, so that only the R gray scale is displayed in the R subframe RSF without being affected by the previous B gray scale data.

Next, an analog voltage signal 41 having a predetermined level VR irrelevant to the B gray scale data is applied to the liquid crystal in the first screen period SP1 of the G subframe GSF. Accordingly, the liquid crystal returns to its original state to be black in response to the analog voltage signal 41. An analog voltage signal 43 having a voltage level V2 corresponding to the G gray scale data is then applied to the liquid crystal in the second screen period SP2, which in turn allows light to be transmitted in response to the applied voltage, so that G light is displayed in a period where the GLED emits light. The liquid crystal, which has been driven by the R gray scale data in the previous R subframe RSF, is reset by the analog voltage signal 41 for reset when the G gray scale is displayed, so that only the G gray scale is displayed in the G subframe GSF without being affected by the previous R gray scale data.

Finally, an analog voltage signal 41 having a predetermined level VR irrelevant to the G gray scale data is applied to the liquid crystal in the first screen period SP1 of the B subframe BSF. Accordingly, the liquid crystal returns to its original state to be black in response to the analog voltage signal 41. An analog voltage signal 44 having a voltage level V1 corresponding to is the B gray scale data is then applied to the liquid crystal in the second screen period SP2, which in turn allows light to be transmitted in response to the applied voltage, so that B light is displayed in a period where the BLED emits light. The liquid crystal, which has been driven by the G gray scale data in the previous G subframe GSF, is reset by the analog voltage signal 41 for reset when the B gray scale is displayed, so that only the B gray scale is displayed in the B subframe BSF without being affected by the previous G gray scale data.

In accordance with the above-mentioned analog driving mode using the reset signal, a predetermined analog voltage irrelevant to the gray scale data is applied in each period where each of the R, G and B subframes RSF, GSF and BSF starts, namely, the first screen period SP1. Accordingly, the analog voltage irrelevant to the gray scale data is provided before the second screen period SP2 for displaying the gray scale data, which resets the liquid crystal such that no light is transmitted. As a result, when the liquid crystal is driven by the applied voltage corresponding to the gray scale data in each second screen period SP2, R, G, and B colors having predetermined gray scales may be displayed in the current subframe regardless of the liquid crystal state of the previous subframe, which leads to an improvement of the response speed of the liquid crystal.

In the exemplary embodiment of the present invention, each of the R, G and B subframes RSF, GSF and BSF is divided into a first screen period SP1 for resetting the liquid crystal and a second screen period SP2 for displaying R, G, and B gray scales, and the liquid crystal driven by the gray scale data of the previous subframe is reset, the gray scale of the current subframe is then displayed. In another exemplary embodiment of the present invention, each of the R, G and B subframes RSF, GSF and BSF is divided into a first screen period SP1 for displaying R, G, and B gray scales, and a second screen period SP2 for resetting the liquid crystal, and the gray scale corresponding to each gray scale data of the current subframe is displayed, and the liquid crystal driven in the current subframe is reset, so that the liquid crystal driven in the current subframe may not affect the next subframe.

Figure 5:
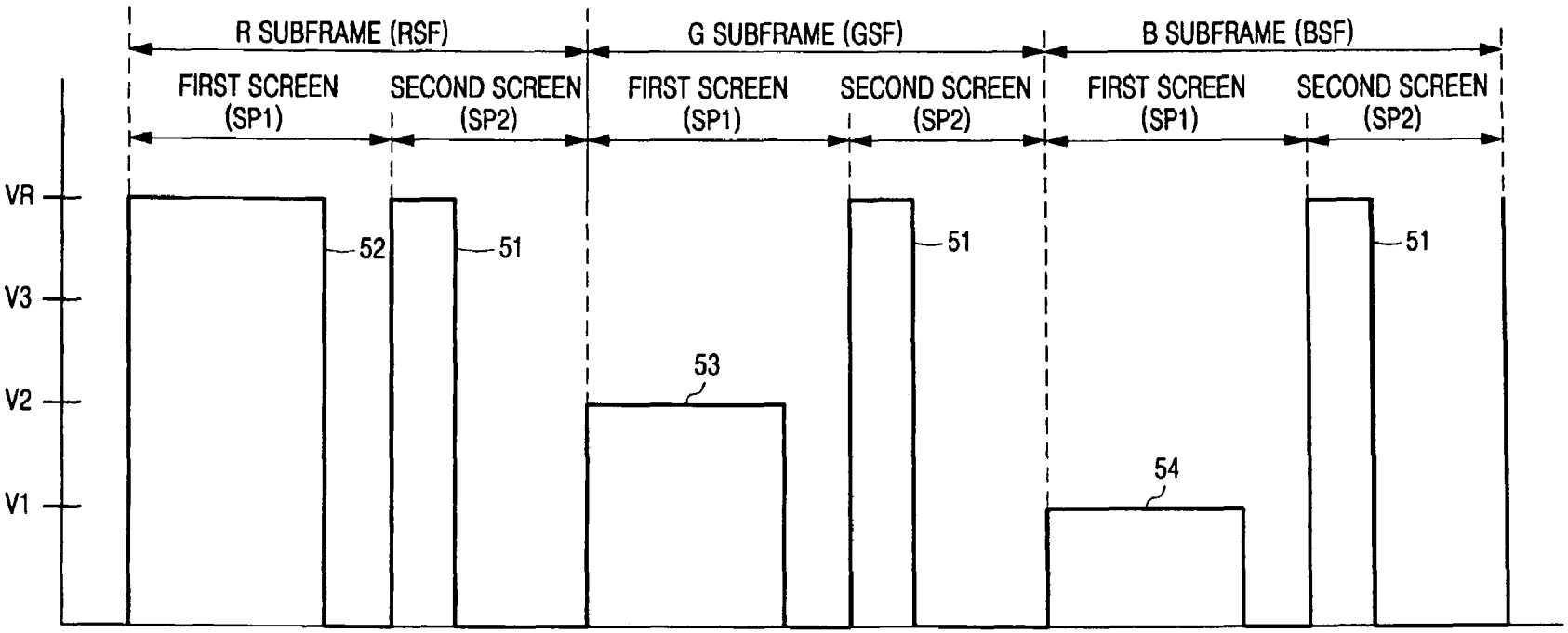
FIG. 5 shows waveforms for explaining a method of driving an LCD using reset pulses in accordance with another exemplary embodiment of the present invention.

Referring to FIG. 5, in another exemplary embodiment of the present invention, one frame is divided into R, G and B subframes RSF, GSF and BSF, and each of R, G and B subframes RSF, GSF and BSF is divided into two periods.

In other words, each of the R, G, and B subframes RSF, GSF and BSF is divided into a first screen period SP1 and a second screen period SP2, and analog voltage signals 52, 53 and 54 having different voltage levels from one another corresponding to gray scale data required to be displayed are applied in the first screen periods SP1 of the RSF, GSF and BSF, respectively. In addition, analog voltage signals 51 for reset are applied to return the liquid crystal to a black state so that no light is transmitted in the second screen period SP2. This is different from the exemplary embodiment of FIG. 4, where the analog voltage signals for reset are applied in the SP1 and the analog voltage signals corresponding to gray scale data are applied in SP2. However, other than the fact that the screen periods in which the reset and display take place have been switched, the principles of the driving method of FIG. 5 is substantially the same as that of FIG. 4, and FIG. 5 will not be described in further detail. By way of example, the absolute value of the analog voltage signal 51 (i.e., VR) for reset is substantially the same as the biggest value of the absolute values of the analog voltage signals corresponding to gray scale data.

In the conventional digital driving mode, when 64 gray scales are required to be displayed, 6 bits should be allocated to the data pulse for displaying the 64 gray scales when 2 bits are allocated to the reset pulse, so that 8 data bits are required to display the 64 gray scales.

On the contrary, in accordance with exemplary embodiments of the present invention, for example, the exemplary embodiment of FIG. 4, an analog voltage signal 41 for resetting the liquid crystal is provided in the first screen period SP1 for returning the liquid crystal to its original state, and analog voltage signals 42, 43 and 44 for driving the liquid crystal are provided, respectively, in the second screen periods SP2 for displaying the gray scale, so that the driving frequency may be reduced to one eighth as compared to the conventional digital driving mode. In addition, the liquid crystal is reset before it is driven to display the gray scale, which may not only increase the response speed of the liquid crystal but also reduce a problem that the effective value response is changed in response to the previously displayed gray scale.

In exemplary embodiments of the present invention, one frame is divided into three subframes of RSF, GSF and BSF, however, it may also include a white (W) subframe for implementing a white color in addition to the R, G, and B subframes. In addition, one frame may include at least three subframes, and these subframes may be used to implement the same color at least twice.

In accordance with the exemplary embodiments of the present invention mentioned above, the liquid crystal driven in the previous subframe may be reset by providing an analog voltage before displaying the gray scale in the current subframe when gray scales are displayed with respect to R, G, and B data in a analog mode, so that the response speed of the liquid crystal may be enhanced. In addition, displaying the full color gray scale may be facilitated without increasing the number of driving data bits, power consumption may be reduced, and the signal distortion due to the driving frequency may be prevented or reduced.

Although the present invention has been described with reference to certain exemplary embodiments thereof, it will be understood by those skilled in the art that a variety of modifications and variations may be made to the present invention without departing from the spirit or scope of the present invention defined in the appended claims, and their equivalents.

What is claimed is:

1. In a liquid crystal display (LCD) having a liquid crystal disposed between upper and lower substrates, a method of sequentially driving the liquid crystal to display a desired color per each of subframes constituting one frame, the method comprising:

applying a first analog voltage signal to the liquid crystal to reset the liquid crystal in a first screen period of each of the subframes; and applying at least one of second analog voltage signals corresponding to gray scale data for displaying gray scale levels to the liquid crystal and driving the liquid crystal to display at least one of the gray scale levels in a second screen period of each of the subframes, wherein each of the subframes includes the first screen period for resetting the liquid crystal and the second screen period for displaying at least one of the gray scale levels, and the first analog voltage signal is a signal having substantially the same absolute value as a biggest value among absolute values of the second analog voltage signals, and the liquid crystal is sequentially driven to display one color per each of the subframes so that the desired color is displayed.

2. The method of claim 1, wherein the one frame includes at least two subframes selected from Red (R), Green (G), Blue (B), and White (W) subframes.

3. The method of claim 1, wherein the first analog voltage signal applied in the first screen period is a reset signal that is irrelevant to the second analog voltage signals for displaying the gray scale levels applied in the second screen periods.

4. The method of claim 1, wherein the second analog voltage signals applied in the second screen periods are data signals having voltage levels different from one another in response to the gray scale data, and are irrelevant to a voltage level of the first analog voltage signal applied in the first screen period.

5. In a liquid crystal display (LCD) having a liquid crystal disposed between upper and lower substrates, a method of sequentially driving the liquid crystal to display a desired color per each of subframes constituting one frame, the method comprising:

applying at least one of first analog voltage signals for displaying gray scale levels corresponding to gray scale data to the liquid crystal in a first screen period of each of the subframes and driving the liquid crystal to display at least one of the gray scale levels; and applying a second analog voltage signal having substantially the same absolute value as a biggest value among absolute values of the first analog voltage signals to the liquid crystal to reset the liquid crystal in a second screen period of each of the subframes, wherein each of the subframes includes the first screen period for displaying at least one of the gray scale levels and the second screen period for resetting the liquid crystal, and the liquid crystal is sequentially driven to display one color per each of the subframes so that the desired color is displayed.

6. The method of claim 5, wherein the one frame includes at least two subframes selected from Red (R), Green (G), Blue (B), and White (W) subframes.

7. The method of claim 5, wherein the second analog voltage signal applied in the second screen period is a reset signal that is irrelevant to the first analog voltage signals for displaying the gray scale levels applied in the first screen periods.

8. The method of claim 7, wherein the first analog voltage signals applied in the first screen periods are data signals having voltage levels different from one another in response to the gray scale data, and are irrelevant to a voltage level of the second analog voltage signal applied in the second screen period.

9. A method of driving a liquid crystal display (LCD) having a liquid crystal disposed between upper and lower substrates, comprising:

applying a first analog voltage signal to the liquid crystal to reset the liquid crystal; and applying at least one of a plurality of second analog voltage signals corresponding to gray scale data for displaying gray scale levels to the liquid crystal and driving the liquid crystal to display at least one of the gray scale levels, wherein the first analog voltage signal has substantially the same absolute value as a biggest value among absolute values of the second analog voltage signals.

10. The method of claim 9, wherein the first analog voltage signal is a reset signal that is irrelevant to the second analog voltage signals for displaying the gray scale levels.

11. The method of claim 9, wherein the second analog voltage signals are data signals having voltage levels different from one another in response to the gray scale data, and are irrelevant to a voltage level of the first analog voltage signal.

12. A method of driving a liquid crystal display (LCD) having a liquid crystal disposed between upper and lower substrates, comprising:

applying at least one of first analog voltage signals corresponding to gray scale data for displaying gray scale levels to the liquid crystal and driving the liquid crystal to display at least one of the gray scale levels; and applying a second analog voltage signal having substantially the same absolute value as a biggest value among absolute values of the first analog voltage signals to the liquid crystal to reset the liquid crystal.

13. The method of claim 12, wherein the second analog voltage signal is a reset signal irrelevant to the first analog voltage signals for displaying the gray scale levels.

14. The method of claim 12, wherein the first analog voltage signals are data signals having voltage levels different from one another in response to the gray scale data, and are irrelevant to a voltage level of the second analog voltage signal.

15. In a liquid crystal display (LCD) having a liquid crystal disposed between upper and lower substrates, a method of sequentially driving the liquid crystal to display a desired color during a period that is divided into a plurality of sections, the method comprising:

applying at least one of first analog voltage signals corresponding to gray scale data for displaying gray scale levels to the liquid crystal per each of the sections and driving the liquid crystal to display at least one of the gray scale levels; and applying a second analog voltage signal having substantially the same absolute value as a biggest value among absolute values of the first analog voltage signals to the liquid crystal to reset the liquid crystal, wherein the liquid crystal is sequentially driven to display one color per each of the sections so that the desired color is displayed during the period.

16. The method of claim 15, wherein the period is one frame, and the one frame includes at least two subframes selected from Red (R), Green (G), Blue (B), and White (W) subframes.

17. The method of claim 15, wherein the second analog voltage signal is a reset signal irrelevant to the first analog voltage signals for displaying the gray scale levels.

18. The method of claim 15, wherein the first analog voltage signals are data signals having voltage levels different from one another in response to the gray scale data, and are irrelevant to a voltage level of the second analog voltage signal.

19. In a liquid crystal display (LCD) having a liquid crystal disposed between upper and lower substrates, a method of sequentially driving the liquid crystal to display a desired color during a period that is divided into a plurality of sections, the method comprising:

applying a first analog voltage signal to the liquid crystal to reset the liquid crystal per each of the sections; and applying at least one of second analog voltage signals corresponding to gray scale data for displaying gray scale levels to the liquid crystal and driving the liquid crystal to display at least one of the gray scale levels, wherein the first analog voltage signal is a signal having substantially the same absolute value as a biggest value among absolute values of the second analog voltage signals, and the liquid crystal is sequentially driven to display one color per each of the sections so that the desired color is displayed during the period.

20. The method of claim 19, wherein the period is one frame, and the one frame includes at least two subframes selected from Red (R), Green (G), Blue (B), and White (W) subframes.

21. The method of claim 19, wherein the first analog voltage signal is a reset signal irrelevant to the second analog voltage signals for displaying the gray scale levels.

22. The method of claim 19, wherein the second analog voltage signals are data signals having voltage levels different from one another in response to the gray scale data, and are irrelevant to a voltage level of the first analog voltage signal.

* * * * *